US006450801B1

(12) United States Patent
Wilnechenko et al.

(10) Patent No.: US 6,450,801 B1
(45) Date of Patent: Sep. 17, 2002

(54) LIQUID FUEL STOVE APPARATUS

(75) Inventors: Bruce Conrad Wilnechenko, Burnaby (CA); Angelo Faccone, Vancouver (CA); Jonathan Young, Vancouver (CA)

(73) Assignee: Teleflex (Canada) Limited, Richmond (CA)

( * ) Notice: Subject to any disclaimer, the term of this patent is extended or adjusted under 35 U.S.C. 154(b) by 0 days.

(21) Appl. No.: 09/429,494

(22) Filed: Oct. 29, 1999

(51) Int. Cl.[7] ..... F23N 1/02; F24B 3/00

(52) U.S. Cl. ..... 431/90; 431/350; 126/25 R; 126/39 B; 126/40

(58) Field of Search ..... 431/90, 89, 79, 431/350, 344; 126/25 R, 29, 30, 9 R, 9 B, 41 R, 39 B, 52, 40, 39 E, 55

(56) References Cited

U.S. PATENT DOCUMENTS

| | | | | |
|---|---|---|---|---|
| 3,577,877 A | * | 5/1971 | Warne | 60/39.28 |
| 3,847,537 A | * | 11/1974 | Velie | 431/90 |
| 3,947,218 A | * | 3/1976 | Landis | 431/79 |
| 4,149,842 A | * | 4/1979 | Benjamin | 431/118 |
| 4,223,692 A | * | 9/1980 | Perry | 137/78.4 |
| 4,340,362 A | * | 7/1982 | Chalupsky et al. | 431/353 |
| 4,431,382 A | * | 2/1984 | Edman et al. | 431/118 |
| 5,080,580 A | * | 1/1992 | Clapp | 126/39 R |
| 5,527,180 A | | 6/1996 | Robinson et al. | |
| 5,927,961 A | * | 7/1999 | Robinson et al. | 431/79 |

FOREIGN PATENT DOCUMENTS

| | | | |
|---|---|---|---|
| EP | 0 328 418 | * | 8/1989 |

* cited by examiner

*Primary Examiner*—Henry Bennett
*Assistant Examiner*—Josiah C. Cocks
(74) *Attorney, Agent, or Firm*—Norman M. Cameron

(57) ABSTRACT

A stove apparatus includes a frame having an interior opening. A burner is mounted within the opening. A liquid fuel container is mounted on the frame within the opening. A fuel conduit extends between the container and the burner. A heat shield extends about the burner and separates the burner from the fuel container. Preferably the apparatus has a manually operable device which simultaneously regulates a valve controlling a flow of fuel from the fuel container to the burner and a control device controlling the output of a compressor supplying compressed air to the burner. The compressor may have a suction port. The apparatus then includes a suction conduit connecting the suction port to the fuel container, whereby the compressor can selectively draw fuel into the container. The fuel container may have a vent body mounted thereon. The suction conduit is connected to the vent body. The body has a valve for preventing fuel from entering the conduit from the container. The valve may include a chamber with a valve seat at the top of the chamber. A check valve ball, buoyant in the fuel, is movably mounted in the chamber. If fuel is drawn into the chamber, the check valve ball floats to the top of the chamber and blocks the fuel from entering the suction conduit.

30 Claims, 13 Drawing Sheets

LIQUID FUEL STOVE APPARATUS

BACKGROUND OF THE INVENTION

This invention relates to liquid fuel stoves and, in particular, to portable liquid fuel stoves for military use.

Portable stoves are used for a variety of purposes such as military operations. They are used in range ovens, steam tables, tray ration heaters, field sanitation equipment and stock pot heating racks. These appliances perform such functions as roasting, grilling, broiling, frying, heating water and other liquids and baking. They are typically utilized in such field equipment as tents, other shelters, containerized mobile kitchens and mobile kitchen trailers. These appliances may also be used in an open field without the benefit of shelter.

Such stoves may operate under difficult field conditions and must be reliable in operation and perform to a high level in order to meet the demands of some users.

Some previous portable stoves have had serious problems and disadvantages. They sometimes take a long time to ignite, are not reliable and may perform inadequately if not operated according to strict procedures. Some are not capable of being re-fueled in an appliance, making it necessary to remove the stoves in order to fuel them. This is both labor intensive and inconvenient in the relatively tight quarters of field kitchens for example. Moreover, some are also labor intensive to operate and maintain. They utilize a pressurized fuel tank which contains an explosive fuel. This may present a potential hazard.

Currently there is a demand for a replacement for certain types of portable stoves. The replacement units preferably should be robust in terms of durability. Service and maintenance should be simple, as they often must be conducted by a technically untrained stove operator. Field service should not require specialized tools. Cleaning should be accomplished by simple procedures such as wiping the stoves down with a soapy wet cloth. Such stoves must be rugged enough to withstand transportation as unrestrained cargo in ground vehicles, often moving over rough terrain.

Also, such units should be capable of burning certain fuels, such as military JP-8 fuel, which some previous stoves are incapable of burning. Also, for some applications, a multifuel stove is desired which would be capable of burning such alternative fuels as JP-8; DFA, DF-1 and DF-2 (military diesel fuels), #1 and #2 diesel fuel, kerosene and JP-5.

Accordingly, it is an object of the invention to provide an improved stove adaptable for a wide variety of purposes including installation in existing appliances such as range ovens, steam tables, tray ration heaters, field sanitation equipment and stock pot heating racks.

It is also an object of the invention to provide an improved stove which is capable of performing such functions as roasting, grilling, broiling, frying, heating water and other liquids and baking.

It is also an object of the invention to provide an improved stove which is capable of being utilized in such field equipment as tents, other shelters, containerized mobile kitchens and mobile kitchen trailers.

Is a further object of the invention to provide an improved stove which is capable of burning JP-8 fuel.

It is a still further object of the invention to provide improved stove which is capable of burning a variety of liquid fuels such as JP-8, diesel fuels or kerosene.

It is still further object of the invention to provide an improved stove which is easy to ignite, reliable to operate and easy to maintain.

It is still further object of the invention to provide an improved stove which can be refueled in the appliance and which does not have a pressurized fuel tank.

SUMMARY OF THE INVENTION

In accordance with these objects, there is provided, according to the invention, a stove apparatus having a frame with an interior opening. There is a burner mounted within the opening. The apparatus includes an air compressor mounted on the frame. There is an air conduit which extends between the compressor and the burner. A liquid fuel container is mounted on the frame within the opening. A fuel conduit extends between the container and the burner. A heat shield extends about the burner and separates the burner from the fuel container. A fuel control valve controls a flow of fuel from the fuel container to the burner. There is a control device for controlling output of the compressor.

In one embodiment, the apparatus has a movable front access panel and controls mounted on the access panel.

There may be a knob which simultaneously regulates the fuel control valve and speed of the compressor.

Preferably the compressor has a suction port. The apparatus then includes a suction conduit connecting the suction port to the fuel container and to a valve operatively connected to the suction conduit. The compressor can selectively draw fuel into the fuel container for refueling the stove.

The fuel container may have a vent body mounted thereon. The suction conduit is connected to the vent body. The vent body is mounted on top of the container and has a fuel tube extending to near the bottom of the container. There may be a float slidingly mounted on the tube and a first switch operatively connected to the compressor. The float has means for actuating a switch to stop operation of the compressor when fuel is near the top of the container.

In one preferred embodiment the body has means for preventing fuel from entering the suction conduit from the container. This includes a chamber having a top and a bottom. There is a check valve seat at the top of the chamber. A check valve ball, buoyant in the fuel, is movably mounted in the chamber. A conduit extends from near the bottom of the chamber to the container. If fuel is drawn into the chamber, the check valve ball floats to the top of the chamber and blocks the fuel from entering the suction conduit. For example, the valve seat may be conical in shape, tapering inwards towards the suction conduit. The chamber may have a frustum shaped portion adjacent the seat. The frustum shaped portion has walls tapering inwardly towards the valve seat which are less acutely sloped than the valve seat.

Stoves according to the invention offers significant advantages over the prior art. They utilize a non-pressurized fuel system which is inherently safer than a pressurized system. The stoves can be refueled in the appliances. They are also capable of burning JP-8 fuel or, alternatively, a variety of different fuels such as JP-8 fuels, military diesel fuels, kerosene or JP-5.

Stoves according to the invention also may include electronic ignition which facilitates starting of the appliance. They are easy to operate and reliable in operation. Warming up time is reduced from 30 minutes to 120 minutes in some prior art devices to approximately 2 minutes. The startup is smoke-free and they are capable of shutting off immediately without going through any elaborate shutdown procedure.

DETAILED DESCRIPTION OF THE PREFERRED EMBODIMENTS

Figure 1:
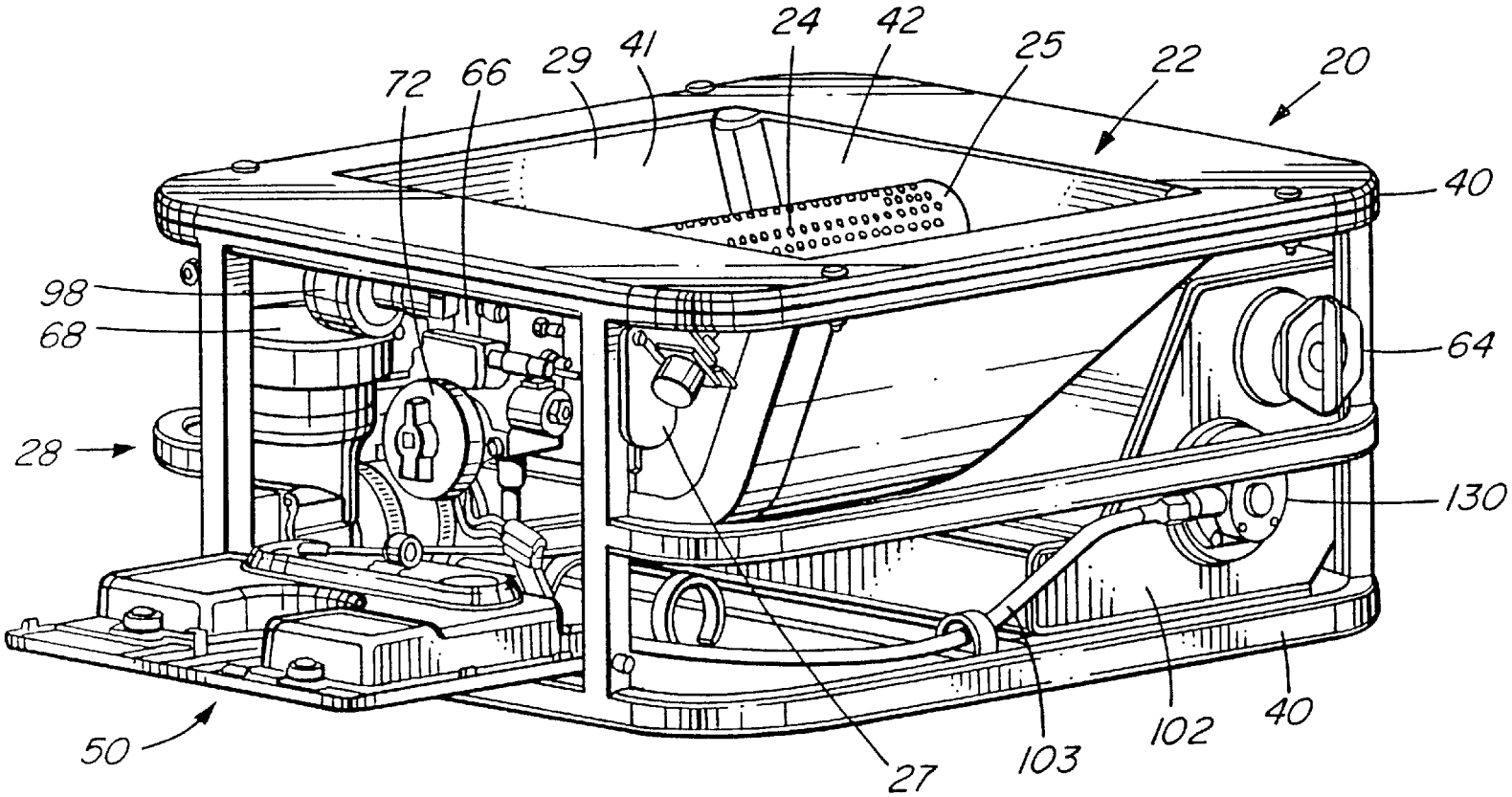
FIG. 1 is an isometric view of a stove according to an embodiment of the invention, the front panel thereof being shown in the open position.
Figure 2:
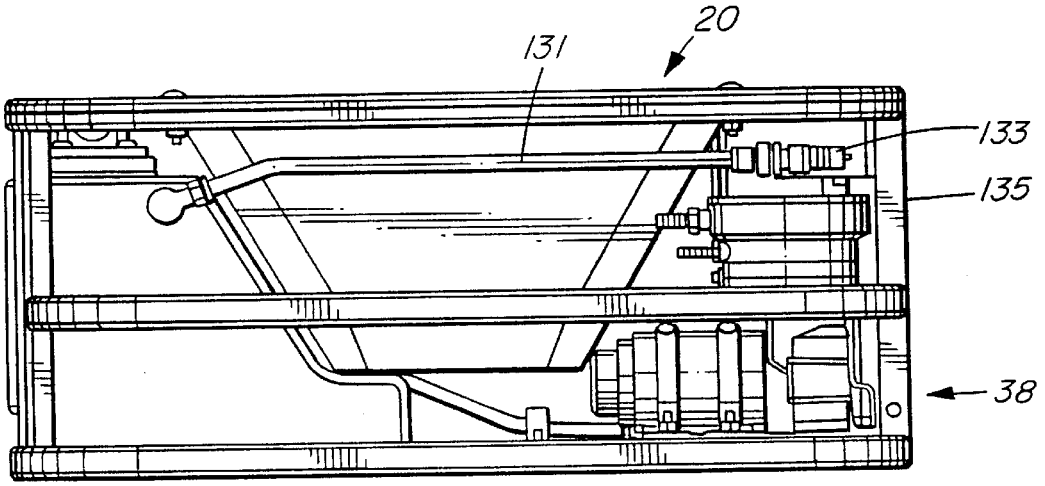
FIG. 2 is a side elevation thereof.
Figure 6:
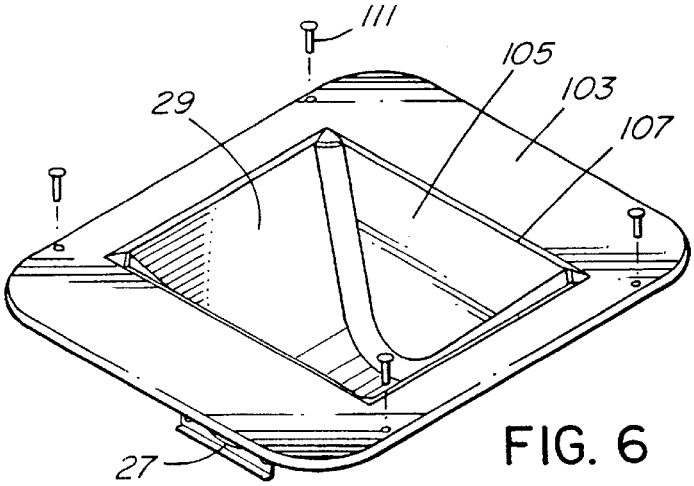
FIG. 6 is an isometric view of the heat shield.

Referring to the drawings, and first to FIGS. 1 and 2, these show a stove 20 according to an embodiment of the invention. The stove has six sub assemblies, the first being frame assembly 22, best shown in FIGS. 1, 5 and 6, which includes frame 40 with an interior opening 41, a fuel container 102 mounted on the frame within the opening, heat shield 103 and a reflector 105 mounted within cavity 107 in the heat shield.

Figure 3:
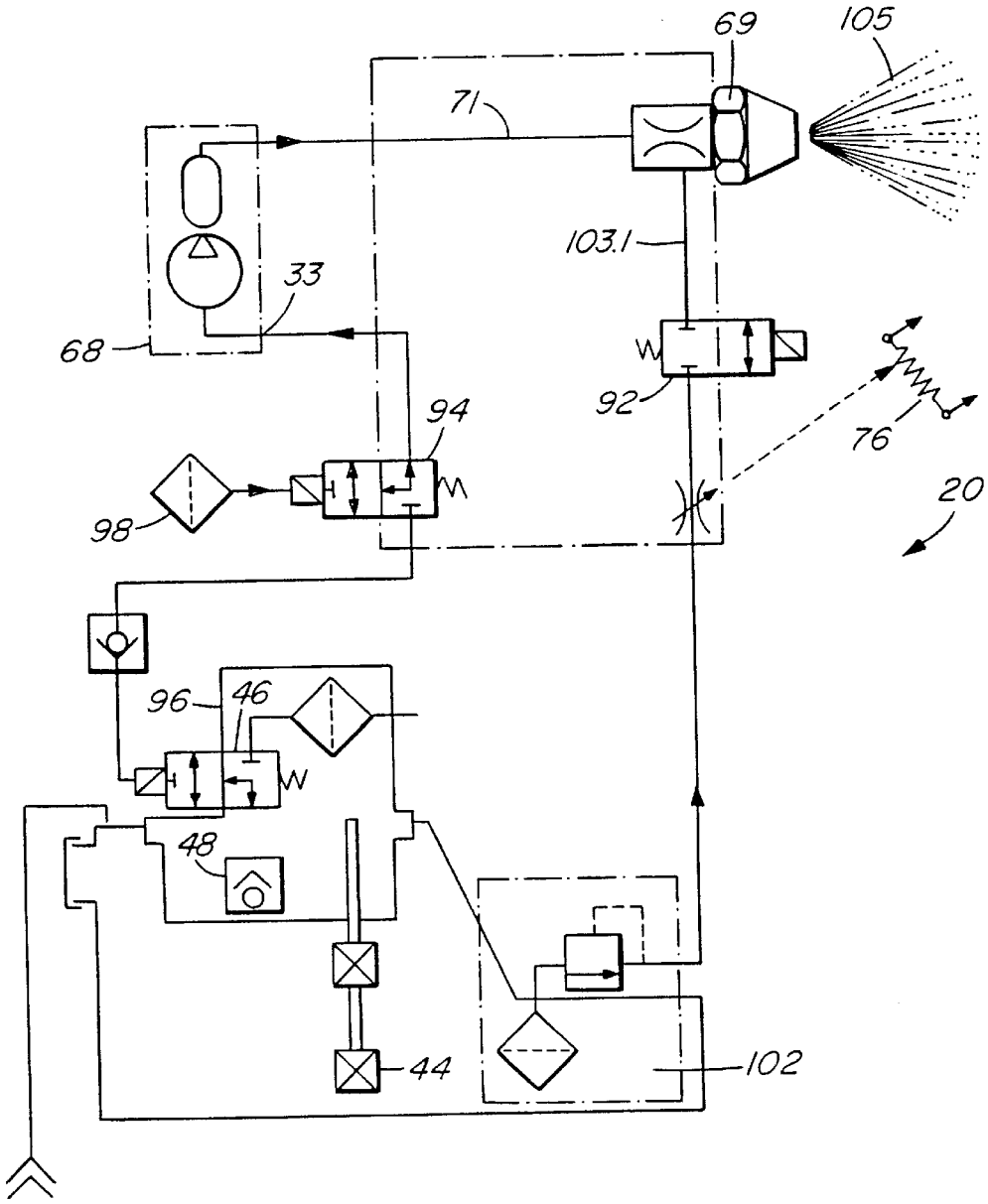
FIG. 3 is a schematic diagram thereof.
Figure 5:
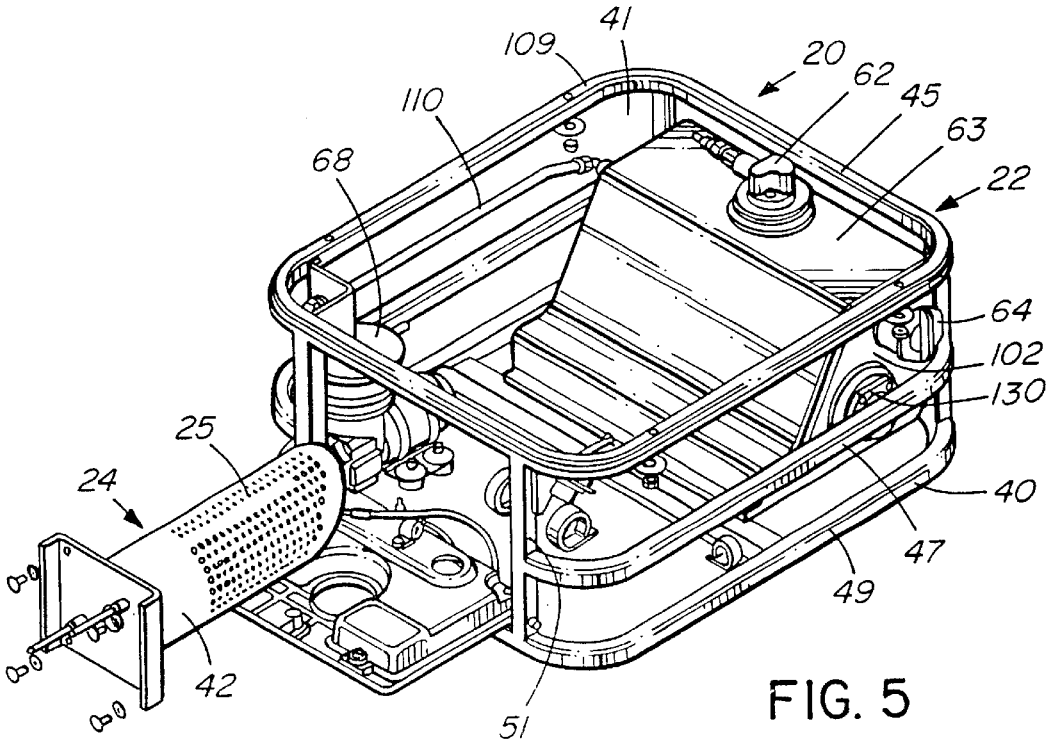
FIG. 5 is an isometric view thereof with the heat shield removed and the burner shown exterior to the frame.
Figure 7:
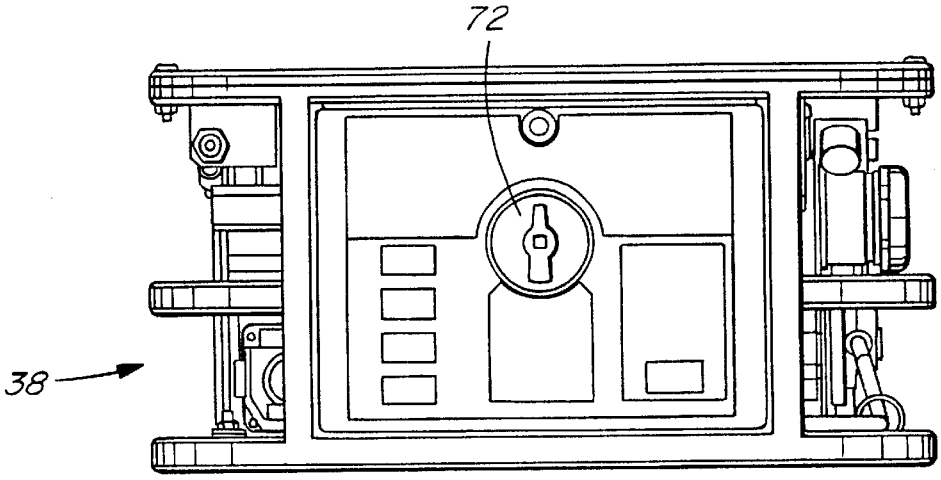
FIG. 7 is a front view thereof.

The second sub assembly is burner assembly 24, shown best in FIG. 5 and schematically in FIG. 3. This includes an air aspiration, infrared burner of a type previously known and disclosed in U.S. Pat. No. 5,527,180. This burner utilizes a two-stage combustion process which recirculates combustion gases to achieve complete fuel vaporization. By recirculating the combustion products and re-burning the gases within the burner head 25, the two-stage process burns virtually all of the hydrocarbons, approaching complete combustion. The benefits of a complete combustion are numerous, including maximum efficiency and heat transfer, no smoke and very low carbon monoxide emissions. When multiple stove units are used in an enclosed kitchen, near complete combustion is necessary to insure the health and safety of cooking staff. The infrared burner technology helps preserve clean breathable kitchen air.

Figure 10:
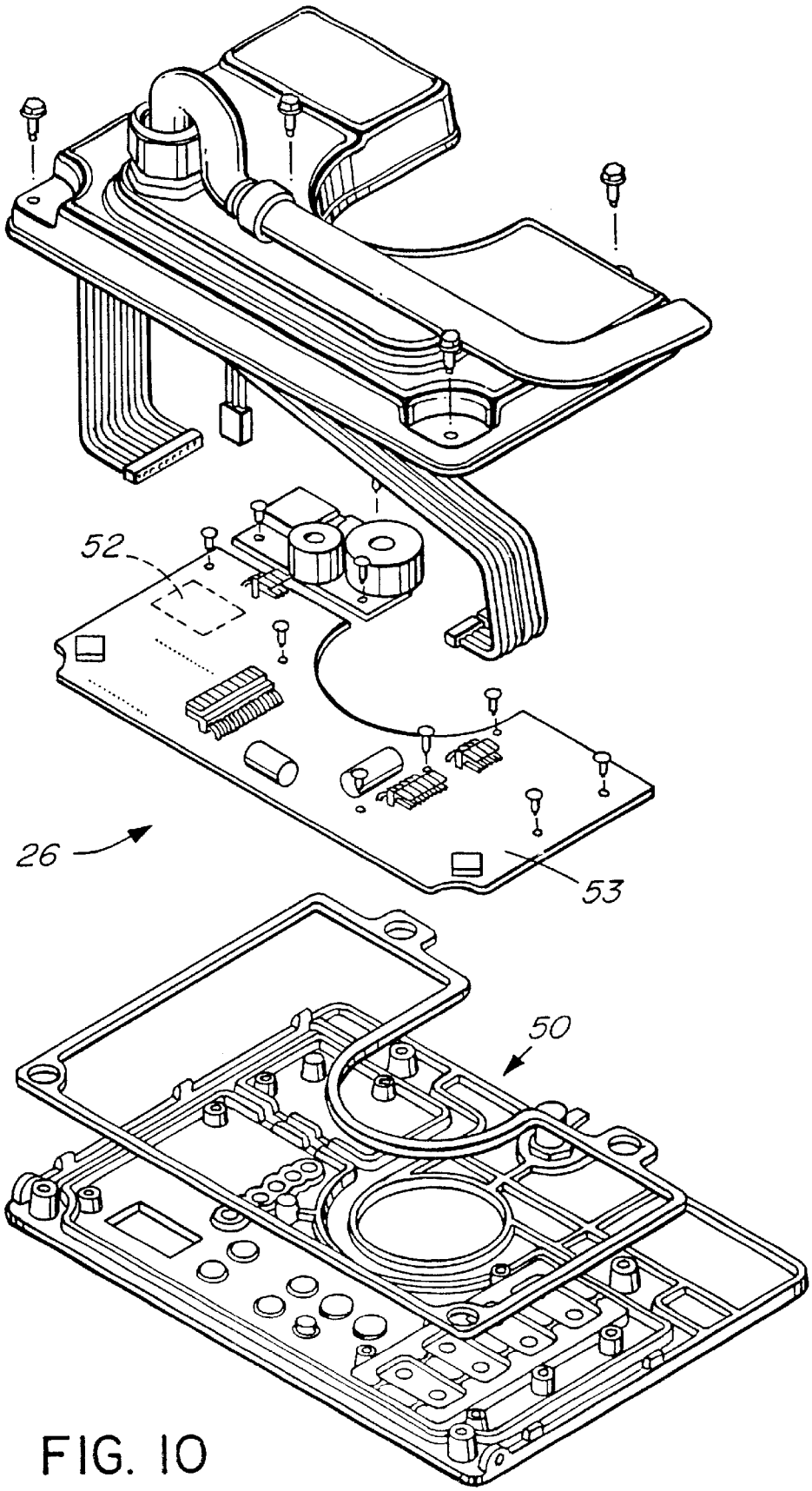
FIG. 10 is an exploded view of the control panel thereof.

The third sub assembly is the controller and associated wire harness assembly 26 shown in FIG. 10 and schematically in FIG. 3.

Figure 12:
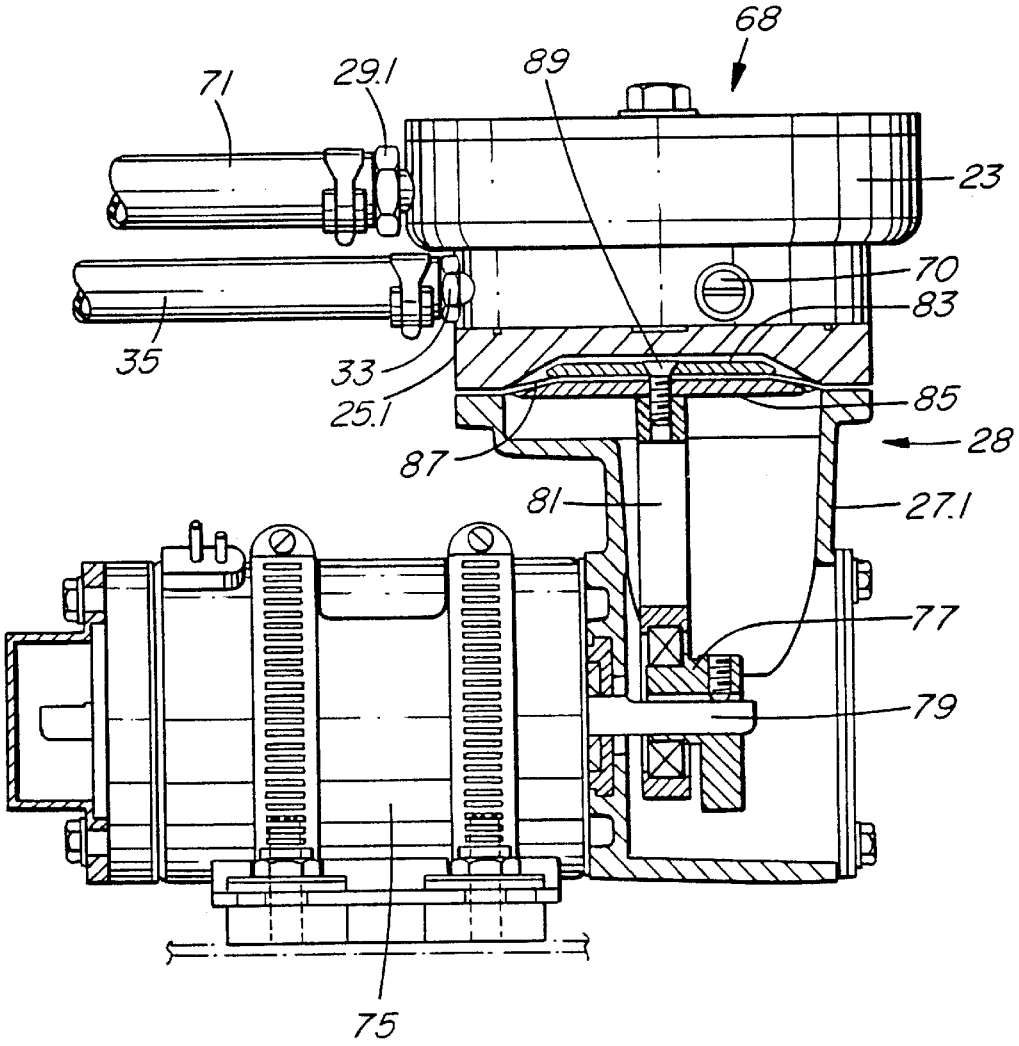
FIG. 12 is aside view, partly in section, of the compressor thereof.
Figure 13:
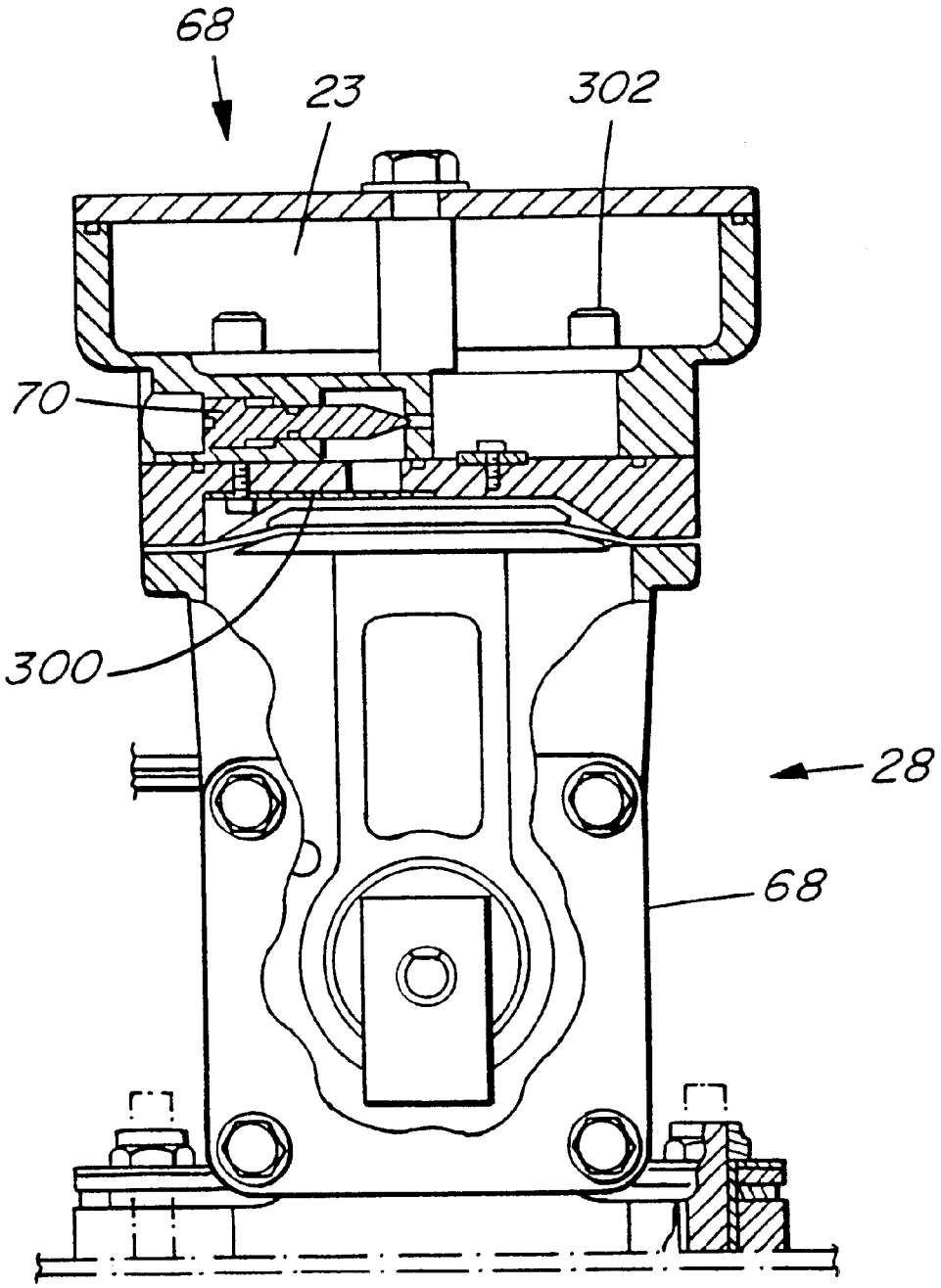
FIG. 13 is a rear view thereof, partly in section and partly broken away.

The fourth sub assembly is compressor assembly 28 shown best in FIGS. 12 and 13. Compressor 68 provides compressed air for nozzle 69 of the burner assembly 24, as shown in FIG. 3. As discussed below, the compressor also serves to draw fuel into the fuel container.

Figure 14:
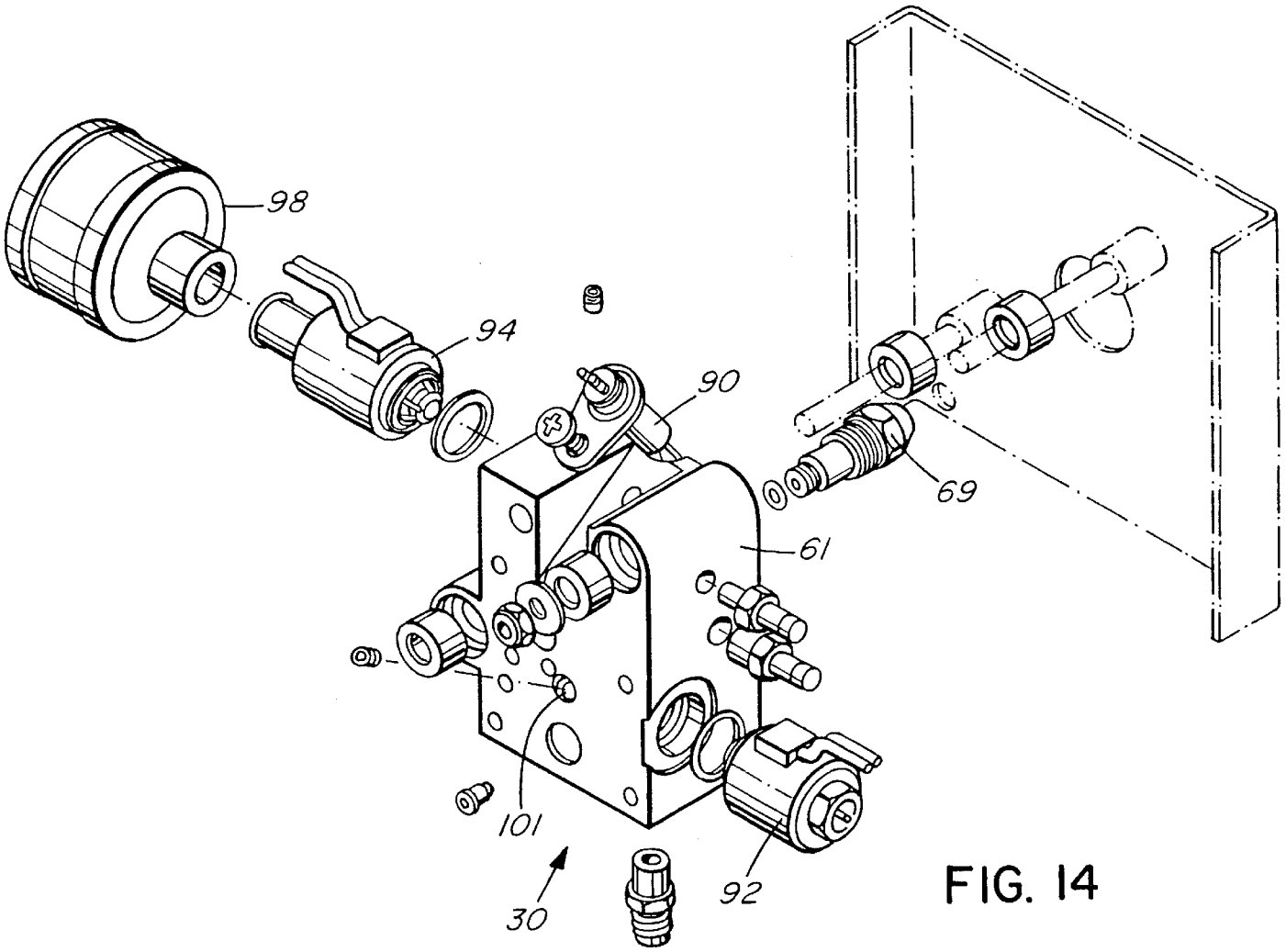
FIG. 14 is an isometric, exploded view of the fueling assembly thereof.

The fifth sub assembly is fuel delivery block assembly 30, shown in FIG. 14. The sixth sub assembly is fuel level/vent assembly 32 shown best in FIG. 9.

Referring to these sub assemblies in more detail, and first to sub assembly 22, frame 40, shown best in FIG. 5, is constructed chiefly of aluminum tubing welded together about opening 41. In this embodiment there are three horizontal tiers of tubing, namely tiers 45, 47, and 49. There is also a plurality of vertical members such as member 51. Thus the frame is a perimeter frame in this example which extends about the central opening 41.

Fuel container 102, somewhat wedge-shaped in this example, is mounted on the frame within the opening. Manual filler cap 64 and fuel regulator 130 are mounted on one side of the container. Vent valve 62 is mounted on top 63 of the container. Heat shield 103, together with reflector 105, are mounted on top 109 of the frame by a plurality of bolts 111 in this example. The heat shield and reflector are of stainless-steel in this example.

Referring to FIG. 5, burner assembly 24 includes burner 42 with burner head 25. When assembled, as seen in FIG. 1, the burner head 25 projects through opening 27 in the heat shield and is located within cavity 29 formed therein. It may be seen that the heat shield extends about the burner and separates the burner from fuel container 102.

The burner is supplied with fuel by air aspiration type nozzle 69 as shown in FIG. 3. The purpose of the nozzle is to transform liquid fuel into a finely atomized spray with increased surface area to promote mixing of the air and fuel and facilitate evaporation. Nozzle 69 is a twin fluid air-assist type nozzle, also known as a siphon type air atomizing nozzle. Introducing high velocity air into the slow-moving fuel causes the fuel to be disintegrated by the mechanical energy from the air. Additionally, the compressed air flows through the nozzle, creating a low-pressure area inside the nozzle cavity. This low-pressure is used to siphon the fuel from the container 102 through the fuel regulator and needle valve described below and the nozzle into the combustion chamber of the burner.

Compressor 68 supplies pressurized air to the nozzle through air conduit 71. The nozzle siphons fuel from fuel container 102 through siphoning fuel line 103.1 and provides an atomized fuel spray 105 which is ignited within the burner. As mentioned above, this type of burner is known and is disclosed in U.S. Pat. No. 5,527,180. The burner utilizes a two-stage combustion process where the combustion products are re-circulated and re-burned, eliminating virtually all hydrocarbons and approaching complete combustion.

Compressor assembly 28, including compressor 68, is shown in FIGS. 1, 12 and 13. The compressor is a single piston diaphragm compressor in this example, although other types of compressors or air pumps could be substituted in alternative embodiments. The compressor includes an electric motor 75 with an eccentric device 77 mounted on shaft 79 thereof. Rod 81 connects the eccentric device to intake disk 83 and compression disk 85 which are connected on opposite sides of diaphragm 87 by screw 89. Rotation of the motor causes reciprocation of the rod and deflection of the diaphragm. There is also an integral accumulator 23 built in to head 25.1 and cylinder 27. 1.

There is an inlet reed valve 300 and an outlet reed valve 302. The diaphragm goes down on intake and draws air through reed valve 300. The diaphragm goes up on output and the compressed air is forced pass reed valve 302. The accumulator volume dampens pulses resulting from this operation.

There is an air pressure adjustment screw 70 to adjust the air pressure. The screw bypasses high-pressure air from the high-pressure side to the low-pressure side. The compressor has an outlet 29.1 for pressurized air connected to conduit 71 and a suction outlet 33 connected to conduit 35.

In this embodiment the fuel delivery nozzle 69 comprises part of fuel delivery block assembly 30 shown in FIG. 14. It is connected to the burner to maintain concentricity so that the fuel spray remains in the center of the burner to minimize impingement on the burner. The nozzle is mounted on one side of block 61 thereof. There is a fuel needle valve 88 which meters fuel to the nozzle to control the rate of flow of fuel.

Figure 15:
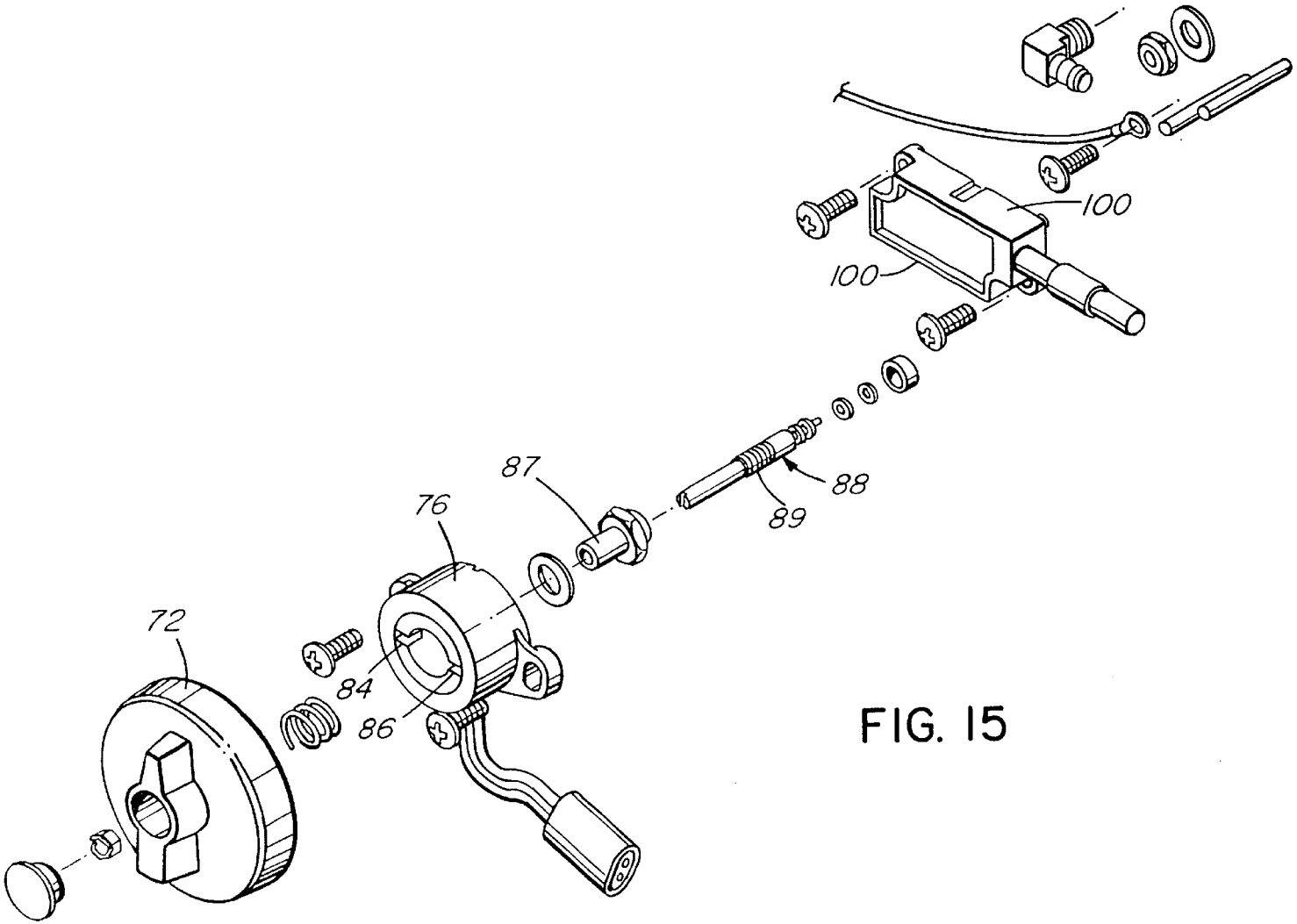
FIG. 15 is a continuation of FIG. 14, showing the flame sensor, needle valve, solenoid for controlling the compressor and the knob of the control panel.
Figure 16:
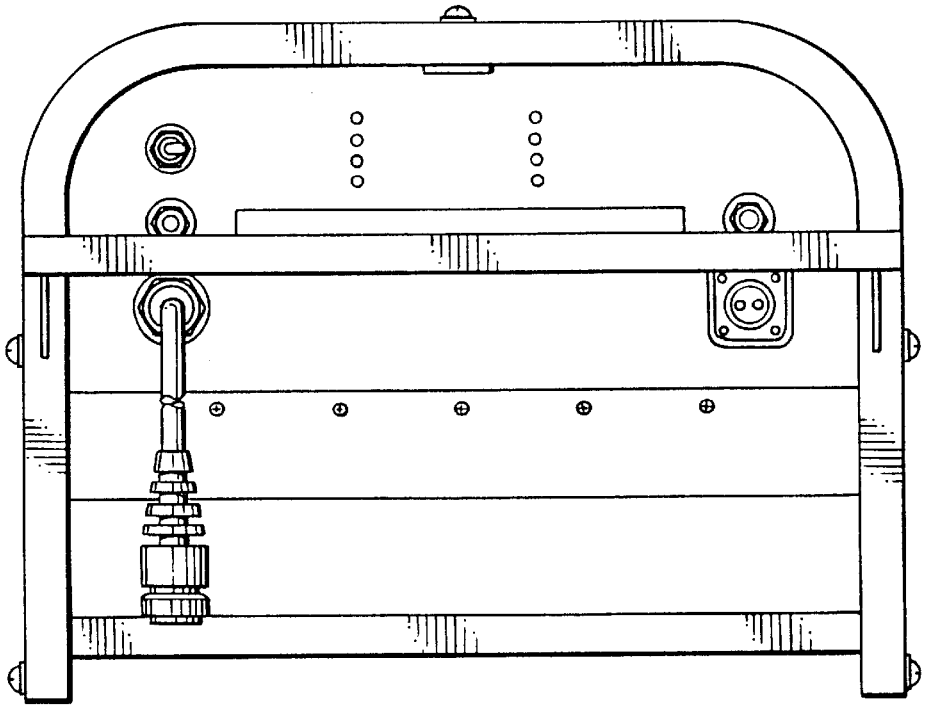
FIG. 16 is a front elevation of the battery pack thereof.

A feedback potentiometer 76, shown in FIG. 15, controls the output of compressor 68 and thereby air pressure to the nozzle 69. As the stove operates, fuel is siphoned from the fuel container through the fuel lines, the shut off solenoid 92, shown in FIGS. 3 and 14, and the needle valve 88 to the nozzle 69. The needle valve controls pressure drop across the metering orifice. This in turn controls the fuel flow to the nozzle. When control knob 72 is adjusted, two fuel flow parameters are altered simultaneously. These two fuel control parameters are arranged so that a linear fuel rate is maintained. This is accomplished by rotation of knob 72 which simultaneously controls the fuel supply to the burner via the needle valve and the compressor output via the feedback potentiometer.

Figure 8:
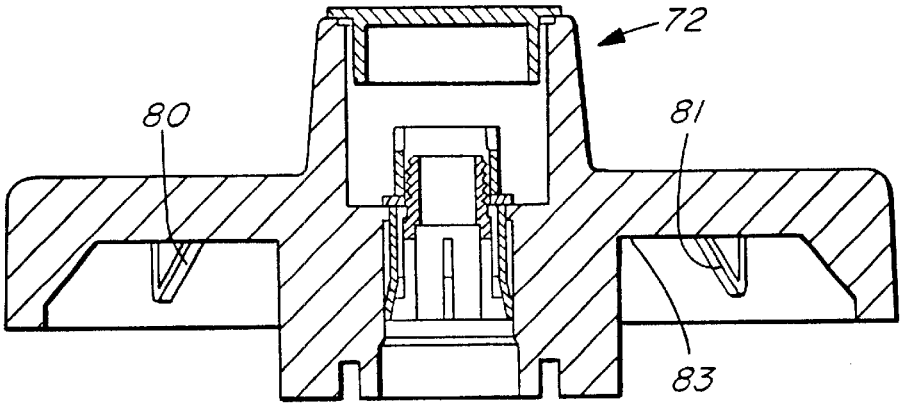
FIG. 8 is a sectional view of the control knob thereof.

As seen in the sectional view of FIG. 8, the knob 72 has a pair of projections 80 and 81 on inner face 83. These are spaced apart and slidingly engage slots 84 and 86 in potentiometer 76, shown in FIG. 15. At the same time, the knob engages cap 87 of needle valve 88. The needle valve has a male threaded stem 89 which engages corresponding female threads in block 61. Therefore rotation of the knob rotates the valve stem, causing axial movement of the valve stem to control the flow of fuel to the nozzle. At the same time, the knob rotates the potentiometer to control the speed of the compressor such that the amount of air supplied to the nozzle is correct for the amount of fuel. The projections allow the knob to continue engagement with the potentiometer, while allowing axial movement of the valve stem by means of an axially compliant coupling.

A flame sensor 100 is also mounted on the block 61 shown in FIG. 15. The flame sensor views the flame in the burner through an aperture 101 in the block 61 shown in FIG. 14. The flame sensor is located immediately beside the nozzle 69, optimizing the viewing angle. The view of the sensor is parallel to the axis of nozzle 69.

The flame sensor measures the flare intensity and converts it to a DC voltage signal rather than steady state light. The sensor is designed to respond to changing light intensity rather than respond to steady-state light intensity. All flames have a characteristic changing light intensity or flicker frequency. The sensor is tuned to respond to a specific flame flicker frequency and ignore other sources of light intensities such as sunlight or fluorescent light. The sensor measures the flame intensity in the infrared spectrum. A threshold value for the DC signal is established. Over this threshold flame is present, below it no flame is present.

An ignitor 90, also mounted on block 61, ignites the air fuel mixture expelled from the nozzle. The ignitor is attached to the block 61 so its position relative to the nozzle and fuel spray is maintained. This is critical to ensure reliable flame ignition and longer ignitor life.

A fuel on/off solenoid valve 92 controls the flow of fuel to the nozzle through conduit 103.1 shown in FIG. 3. Three-way, two position solenoid valve 94 selects between air filter 98 and the vent assembly 32 described below. This allows the suction outlet 33 of the compressor shown in FIG. 12 to select between two operating modes. The first, with the valve in the normal position, is where air is drawn through air filter 98 for normal operation of the compressor to supply compressed air to the nozzle. The second mode, with the valve in the energized position, is to draw air from the fuel container 102 during the refueling operation described below.

Figure 9:
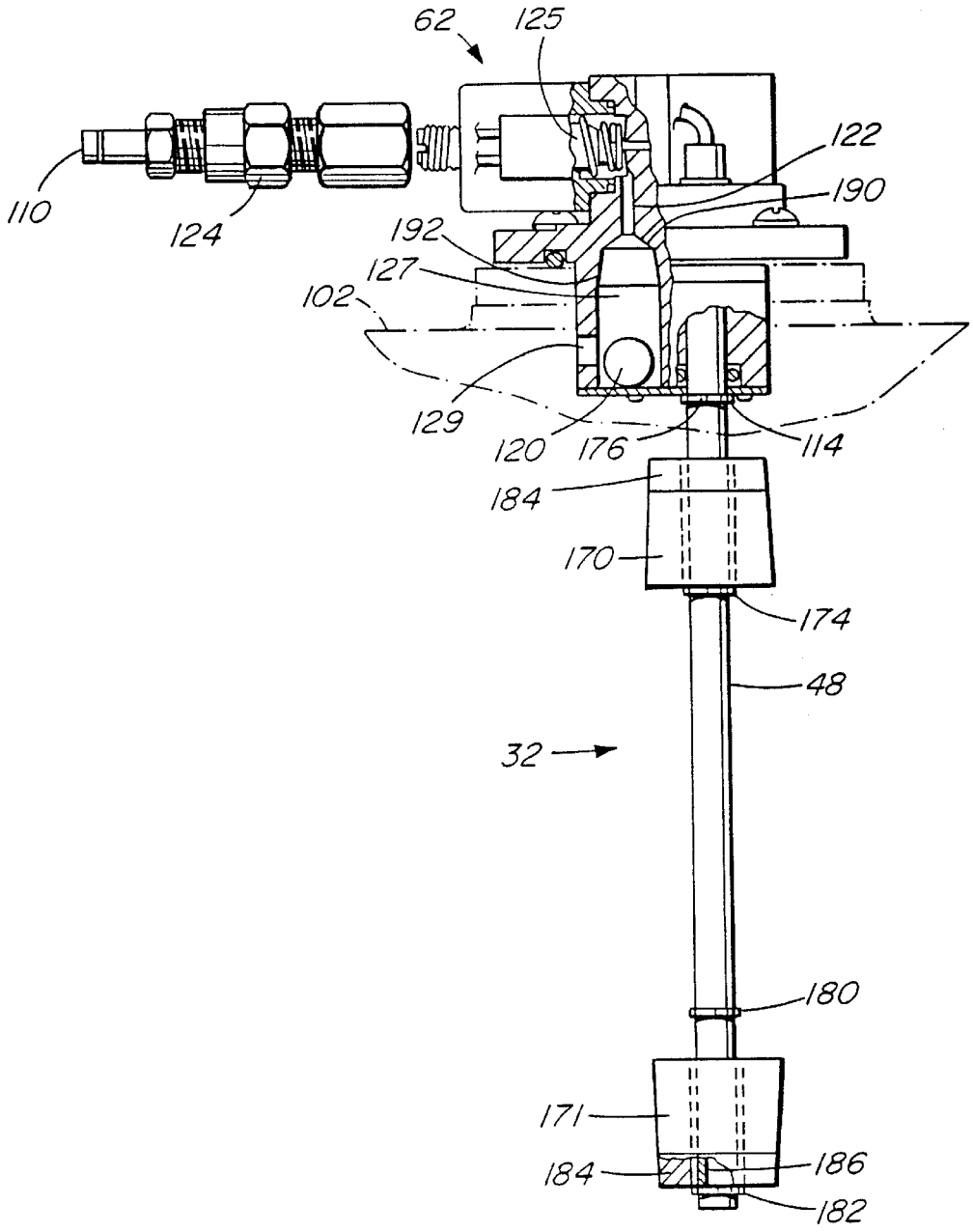
FIG. 9 is a side view, partly in section, of the vent assembly for the fuel tank thereof.

The sixth sub assembly, namely fuel level/air vent assembly 32, shown in FIG. 9, includes a vent body 62 mounted on top of the fuel container 102. The suction conduit 35 from the compressor, shown in FIG. 12, is connected to fitting 110 shown in FIG. 9 which is equipped with a check valve 124. There is a solenoid valve 125 in the vent body which opens or closes the suction conduit. The valve opens to keep the fuel at atmospheric pressure when the stove is operational. During refueling, this valve is closed. It is also normally closed when the stove is non-operational. A suction conduit 122 extends between the solenoid valve and chamber 127 equipped with a fuel - resistant buoyant float 120. The chamber communicates with the inside of the container through opening 129. During refueling operations, suction is applied to the fitting 110 by the compressor, drawing air from the container and drawing fuel into the container through fuel line 131 shown in FIG. 2. There is a quick connect fitting 133 on the fuel line adjacent front 135 of the stove. A hose from a fuel supply is coupled to this fitting during the refueling operation.

There is a vertical tube 48, shown in FIG. 9, brass in this example, which extends downwardly from vent body 62 to a position near the bottom of fuel container 102. A pair of floats 170 and 171 are slidingly mounted on the tube. An annular stop 174 keeps float 170 near the top of the rod, while stop 176 limits its upward movement. Likewise float 171 has upper and lower stops 180 and 182. Each of the floats has a magnet 184. There is an internal reed switch 186 inside tube 48 adjacent each of the floats (only one shown). The switch adjacent float 171 is activated when the float reaches the lower position as illustrated. This provides a signal to the processor that the fuel container is near empty. The switch adjacent float 170 is positioned so it is activated when the float reaches the upper position against stop 176. This signals the processor that the fuel tank is full and stops the compressor.

If float 170 fails to signal the processor and stop the compressor, then spherical float 120 rises in chamber 127 as fuel fills the chamber. The float acts as a check valve ball and rises against check valve seat 190 at the top of chamber. It may be observed that the check valve seat is conical in shape, tapering inwardly towards suction conduit 122. This shape allows the ball to seal the conduit, but inhibits the ball from sticking in that position. The conduit has a frustum shaped portion 192 adjacent to the seat. This portion has walls tapering inwardly towards the valve seat, but they are less acutely sloped than the valve seat. This causes a Venturi effect which draws the ball 120 upwardly towards the valve seat, helping it seat in position to prevent fuel from entering the suction conduit and the compressor.

Figure 4:
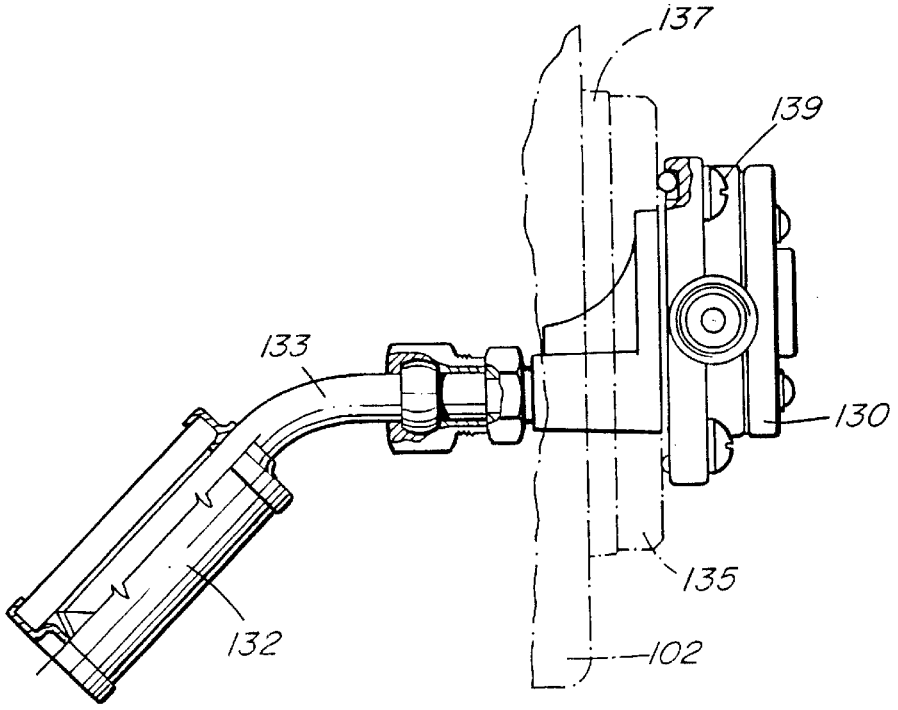
FIG. 4 is a side view, partly broken away, showing the fuel regulator and fuel pickup tube thereof and a fragment of the fuel tank in ghost.
Figure 17:
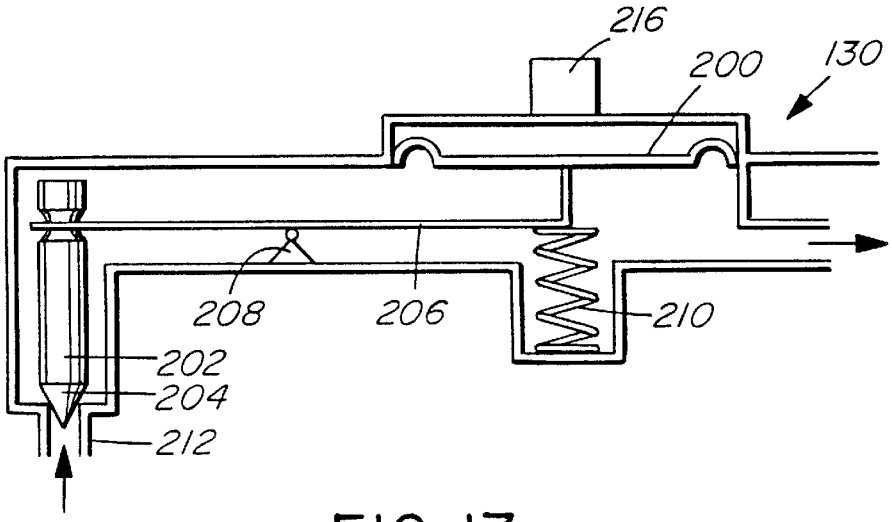
FIG. 17 is a diagrammatic view of the fuel regulator thereof.

There is a regulator 130, shown in FIGS. 1, 4 and 17, which compensates for the changing lift height as the fuel is consumed so that the nozzle suction pressure remains constant. This maintains a constant fuel flow as the fuel level in the fuel container changes. Fuel has mass. Therefore, if the fuel level is high it needs less suction to lift. More suction is needed as the fuel is consumed. The regulator compensates for this.

Referring to FIG. 17, the regulator 130 in this embodiment is adapted from a chainsaw regulator. It includes a diaphragm 200 and a needle valve 202 having a rubber tip 204. There is a lever 206 mounted on a fulcrum 208 which engages the needle valve and the diaphragm. There is a coil spring 210 which biases the lever towards the diaphragm. Normally the spring counters atmospheric pressure. The needle valve is pushed down and seals inlet 212. A vacuum however deflects the diaphragm. The atmosphere pushes downwardly and opens the inlet. The diaphragm has a sintered bronze filter 216 which keeps dirt out of the diaphragm.

The regulator opens and allows fuel to flow only when a vacuum is present in the fuel line. Air under pressure is supplied to the nozzle. The Venturi effect creates a vacuum for suction to the nozzle. When the compressor stops, the vacuum is lost and the regulator stops the flow of fuel.

There is a fuel filter 132 attached to inlet 133 of the regulator as seen in FIG. 4. The filter insures that the fuel passing into the fuel system is clean and prevents clogging of the fuel nozzle.

The fuel regulator is mounted on a boss 135 on the side of the fuel container 102. It is sealed by means of an O-ring 137. Screws 139 attach the regulator to the fuel container. The regulator is mounted low on the fuel container to maximize its effectiveness in compensating for changing fuel level.

Controller assembly 26, best seen in FIG. 10, is mounted on the back of door 50 which is hingedly mounted to the frame adjacent its bottom, allowing the door to pivot open as seen in FIG. 1. There is a latch 51, shown in FIG. 11, which normally keeps the door closed.

Controller 52 is a microprocessor built into the back of circuit board 53.

Figure 11:
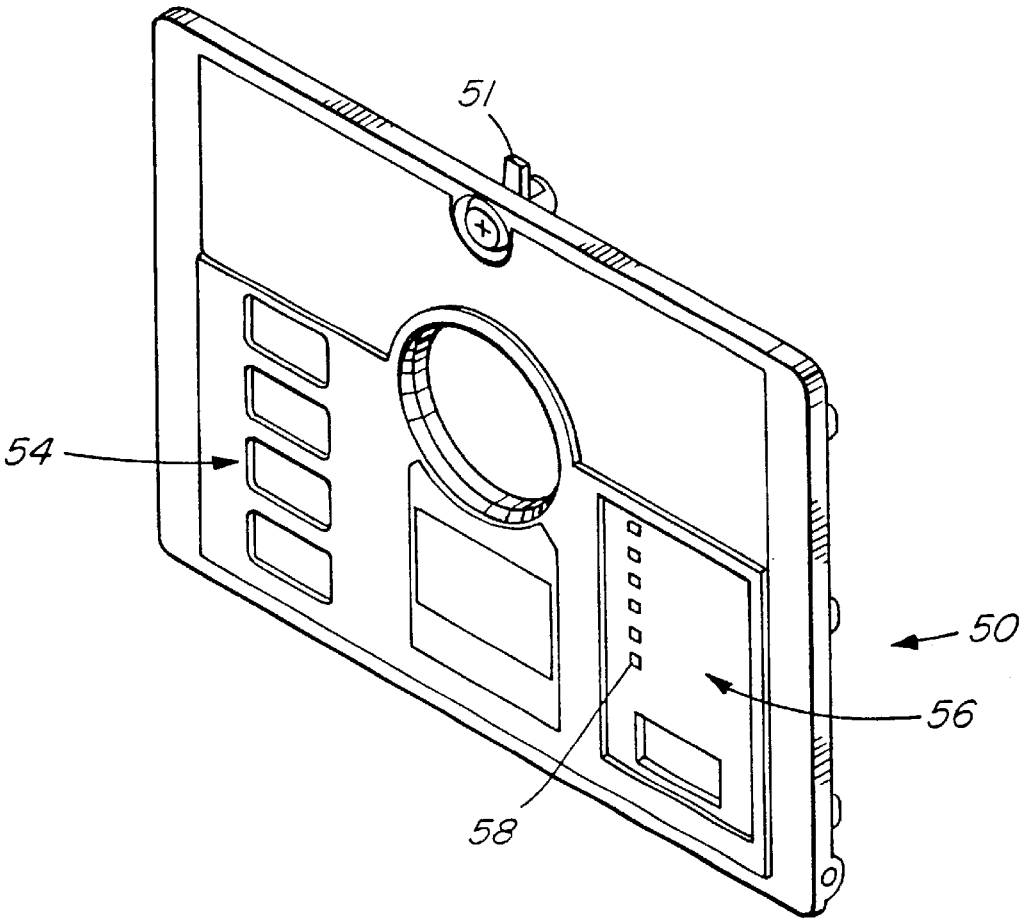
FIG. 11 is a front, isometric view of the control panel.

The front of the door serves as a control panel as shown in FIG. 11 including keypad 54 and indicator lights 58. Thus the door provides two functions, front access to the interior of the stove and as controller packaging. The controller controls all electrical and process functions of the stove. It is microprocessor based. The micro-processor controls and modulates the input voltage and outlet as constant voltage to the components using PWM control. Each of the output circuits utilizes MOSFET style transistors with internal thermal protection to control the required devices.

LED panel 58 indicates to the operator flame hours and also error messages from internal diagnostics.

It will be understood by someone skilled in the art that many of the details described above are by way of example only and are not intended to limit the scope of the invention which is to be interpreted with reference to the following claims.

What is claimed is:

1. A stove apparatus, comprising:

a frame having an interior opening;

a burner mounted within the opening;

an air compressor mounted on the frame;

an air conduit extending between the compressor and the burner;

a liquid fuel container mounted on the frame within the opening;

a fuel conduit extending between the container and the burner;

a heat shield extending about the burner and separating the burner from the fuel container;

a fuel control valve controlling a flow of fuel from the fuel container to the burner;

a control device for controlling output of the compressor; and a manually operable device which simultaneously regulates the valve and speed of the compressor.

2. An apparatus as claimed in claim 1, wherein the apparatus has a movable front access panel and controls mounted on the access panel.

3. An apparatus as claimed in claim 1, wherein the manually operable device is a knob.

4. An apparatus as claimed in claim 3, wherein the control device is a rotary device operated by rotation of the knob.

5. An apparatus as claimed in claim 4, wherein the fuel control valve has a threaded valve stem, whereby rotation of the valve stem causes axial movement of the valve stem to control the flow of fuel, the valve stem being operatively connected to the knob, whereby rotation of the knob controls the flow of fuel.

6. An apparatus as claimed in claim 5, wherein the knob has projections and the control device has slots which slidingly engage the projections, allowing axial movement of the knob with respect to the controller.

7. An apparatus as claimed in claim 6, wherein the control device is a potentiometer.

8. A stove apparatus, comprising:

a frame having an interior opening;

a burner mounted within the opening;

an air compressor mounted on the frame, the compressor having a suction port;

an air conduit extending between the compressor and the burner;

a liquid fuel container mounted on the frame within the opening, the fuel container having a vent body mounted thereon, a first valve being mounted in the vent body;

a suction conduit connecting the suction port to the fuel container, the suction conduit being connected to the vent body, the first valve selectively allowing communication between the container and the compressor;

a valve operatively connected to the suction conduit, whereby the compressor can selectively draw fuel into the container;

a fuel conduit extending between the container and the burner;

a heat shield extending about the burner and separating the burner from the fuel container;

a fuel control valve controlling a flow of fuel from the fuel container to the burner;

a control device for controlling output of the compressor; and a vent body mounted on the fuel container, the suction conduit being connected to the vent body, the body having means for preventing fuel from entering the suction conduit from the container, the means for preventing including a chamber having a top and a bottom, a check valve seat at the top of the chamber, and a check valve ball, buoyant in the fuel, movably mounted in the chamber, whereby if fuel is drawn into the chamber, the check valve ball floats to the top of the chamber and blocks the fuel from entering the suction conduit.

9. An apparatus as claimed in claim 8, wherein the first valve is a solenoid valve.

10. An apparatus as claimed in claim 8, wherein the fuel container has a top and a bottom, the vent body being mounted on the top of the container and having a fuel tube extending to near the bottom of the container.

11. An apparatus as claimed in claim 10, including a first float slidingly mounted on the tube and a first switch operatively connected to the compressor, the first float having means for actuating the first switch when fuel in the container is near the top thereof to stop operation of the compressor.

12. An apparatus as claimed in claim 11, including a second float slidingly mounted on the tube and a second switch operatively connected to a signaling device, the second float having means for actuating the second switch when fuel in the container is near the bottom thereof to operate the signaling device and indicate that the container is near empty.

13. A stove apparatus, comprising:

a frame having an interior opening;

a burner mounted within the opening;

an air compressor mounted on the frame, the compressor having a suction port;

an air conduit extending between the compressor and the burner;

a liquid fuel container mounted on the frame within the opening;

a suction conduit connecting the suction port to the fuel container;

a valve operatively connected to the suction conduit, whereby the compressor can selectively draw fuel into the container;

a fuel conduit extending between the container and the burner;

a heat shield extending about the burner and separating the burner from the fuel container;

a fuel control valve controlling a flow of fuel from the fuel container to the burner;

a control device for controlling output of the compressor; and a vent body mounted on the fuel container, the suction conduit being connected to the vent body, the body having means for preventing fuel from entering the suction conduit from the container, the means for preventing including a chamber having a top and a bottom, a check valve seat at the top of the chamber, the valve seat being conical in shape and tapering inwardly towards the suction conduit, and a check valve ball, buoyant in the fuel, movably mounted in the chamber, whereby if fuel is drawn into the chamber, the check valve ball floats to the top of the chamber and blocks the fuel from entering the suction conduit.

14. An apparatus as claimed in claim 13, wherein the chamber has a frustum shaped portion adjacent the seat.

15. An apparatus as claimed in claim 14, where in the frustum shaped portion has walls tapering inwardly towards the valve seat which are less acutely sloped than the valve seat.

16. A stove apparatus, comprising;

a frame;

a burner mounted on the frame, the burner having a nozzle;

an air compressor mounted on the frame having an intake and an outlet;

an air conduit extending between the outlet of the compressor and the burner;

a liquid fuel container mounted on the frame within the opening;

a fuel conduit extending between the container and the burner;

a suction conduit connecting the intake of the compressor to the fuel container;

a first valve which selectively opens the suction conduit to refuel the tank;

a fuel delivery block, the nozzle and the first valve being mounted on the fuel delivery block; and a potentiometer for controlling the air compressor, the potentiometer being mounted on the fuel delivery block.

17. A stove apparatus as claimed in claim 16, including a second valve which selectively opens the intake of the compressor, the second valve being mounted on the fuel delivery block.

18. A stove apparatus as claimed in claim 17, including a third valve which controls fuel to the burner through the fuel conduit, the third valve being mounted on the fuel delivery block.

19. A stove apparatus as claimed in claim 16, wherein the fuel container includes a vent for venting the container during stove operation.

20. A stove apparatus as claimed in claim 16, including a solenoid valve which vents the fuel container during stove operation.

21. A stove apparatus, comprising:

a frame;

a burner mounted on the frame, the burner having a nozzle;

an air compressor mounted on the frame having an intake and an outlet;

an air conduit extending between the outlet of the compressor and the burner;

a liquid fuel container mounted on the frame within the opening;

a fuel conduit extending between the container and the burner;

a suction conduit connecting the intake of the compressor to the fuel container;

a first valve which selectively opens the suction conduit to refuel the tank;

a fuel delivery block, the nozzle and the first valve being mounted on the fuel delivery block;

a second valve which selectively opens the intake of the compressor, the second valve being mounted on the fuel delivery block;

a third valve which controls fuel to the burner through the fuel conduit, the third valve being mounted on the fuel delivery block; and a control device to vary compressor output.

22. A stove apparatus as claimed in claim 21, wherein the control device is a potentiometer and the third valve is a needle valve.

23. A stove apparatus as claimed in claim 22, including a mechanism for simultaneously adjusting the potentiometer and the needle valve.

24. A stove apparatus comprising a burner having a siphon type air atomizing nozzle; a non-pressurized fuel system including a container, a fuel control valve, and a fuel siphon conduit connecting the fuel container to the nozzle via the fuel control valve, whereby the nozzle siphons fuel from the container; a compressor with variable output; a compressor control which regulates speed of the compressor; an air conduit which connects the compressor to the nozzle; and a burner control which simultaneously operates the fuel control valve and the compressor control, whereby, when burner output is adjusted by the burner control, fuel and air flow to the burner are simultaneously controlled so that the amount of air supplied to the nozzle is correct for the amount of fuel supplied to the nozzle.

25. The stove apparatus as claimed in claim 24, wherein the burner control is manually operable.

26. A stove apparatus comprising a burner having a siphon type air atomizing nozzle; a non-pressurized fuel system including a container, a fuel control valve, and a fuel siphon conduit connecting the fuel container to the nozzle via the fuel control valve, whereby the nozzle siphons fuel from the container; a compressor with variable output; a compressor control which regulates output of the compressor; an air conduit which connects the compressor to the nozzle; and a manually operable burner control which simultaneously operates the fuel control valve and the compressor control, the burner control being a rotary device whereby, when burner output is adjusted by the burner control, fuel and air flow to the burner are simultaneously controlled so that the amount of air supplied to the nozzle is correct for the amount of fuel supplied to the nozzle.

27. The stove apparatus as claimed in claim 26, including a knob for manually rotating the rotary device and thereby simultaneously controlling air and fuel supplied to the nozzle.

28. The stove apparatus as claimed in claim 27, wherein the knob has projections and the compressor control has slots which slidingly engage the projections, allowing axial movement of the knob with respect to the compressor control.

29. The stove apparatus as claimed in claim 28, wherein the compressor control is a potentiometer.

30. A stove apparatus comprising a frame having an interior opening; a burner mounted within the opening, the burner having an air aspiration type nozzle; a variable speed air compressor mounted on the frame; an air conduit extending between the compressor and the burner; a non-pressurized fuel system including a liquid fuel container mounted on the frame within the opening, a siphon fuel conduit extending between the fuel container and the nozzle and a fuel control valve controlling a flow of fuel from the fuel container to the burner; a heat shield extending about the burner and separating the burner from the fuel container; a control device for controlling output of the compressor; and a manually operable device which simultaneously regulates the fuel control valve and the speed of the compressor, whereby the amount of air supplied to the burner is correct for the amount of fuel supplied to the burner.

* * * * *